US005363959A

United States Patent [19]

Crosby et al.

[11] Patent Number: 5,363,959

[45] Date of Patent: Nov. 15, 1994

[54] BRUSH KEEPERS

[75] Inventors: Everett A. Crosby, Homerville; William P. Camp, Jr., Wooster, both of Ohio

[73] Assignee: The Wooster Brush Company, Wooster, Ohio

[21] Appl. No.: 187,348

[22] Filed: Jan. 27, 1994

[51] Int. Cl.[5] ..... B65D 75/14; B65D 5/50

[52] U.S. Cl. ..... 206/362.4

[58] Field of Search ..... 206/362.4, 15.2, 15.3

[56] References Cited

U.S. PATENT DOCUMENTS

| | | | |
|---|---|---|---|
| 1,931,293 | 10/1933 | Morck | 206/362.4 |
| 2,057,828 | 10/1936 | Hartwell | 206/362.4 |
| 2,290,359 | 7/1942 | Ringler | 206/362.4 |
| 2,506,954 | 5/1950 | First | 206/362.4 |
| 2,609,920 | 9/1952 | Ringler | 206/362.4 |
| 2,841,273 | 7/1958 | Scott | 206/362.4 |
| 2,984,401 | 5/1961 | Herkender | 206/362.4 |
| 3,391,782 | 7/1968 | Kaspar . | |
| 3,800,998 | 4/1974 | Gask | 206/362.4 |
| 4,606,456 | 8/1986 | Kaminski | 206/362.4 |

*Primary Examiner*—William I. Price
*Attorney, Agent, or Firm*—Renner, Otto, Boisselle & Sklar

[57] ABSTRACT

A one piece brush keeper or container for protecting and maintaining the shape of the bristles of a brush before and after use includes a main panel which covers a front face of the bristles and bristle holding portion of a brush, lateral panels which wrap around sides of the bristles and bristle holding portion and overlap a back face of the brush, a lower end panel having a radially cornered and tapered locking tab receiving slit which folds around the brush tip and overlaps the lateral panels, and an upper end panel which folds over a top of the bristle holding portion and overlaps the lateral panels and the lower end panel and interlocks with the lower end panel by insertion of a narrow neck radially rounded and tapered locking tab at a distal end of the upper end panel into the locking tab receiving slit. The locking mechanism of the narrow neck radially rounded and tapered locking tab with the radially cornered and tapered locking tab receiving slit allows for repeated opening and closing of the keeper without damaging the locking mechanism. Indentations in the edges of the upper end panel assist in the engagement and disengagement of the locking tab in the locking tab receiving slit. The bottom of the keeper may be straight or angled to accommodate either straight or angle tipped brushes.

24 Claims, 5 Drawing Sheets

BRUSH KEEPERS

FIELD OF THE INVENTION

This invention relates to reusable keepers or containers for brushes.

BACKGROUND OF THE INVENTION

Brush keepers such as covers or holders which fit over the bristles and ferrule portion of a brush such as a paint brush are useful in protecting the brush bristles during shipping and handling and for maintaining original bristle shape after use. Reusable keepers constructed of, for example, paperboard or other foldable material have been devised which wrap around the bristles and bristle holding portion of a brush with an opening for the handle to protrude from the keeper, and a locking mechanism to lock upon itself over the brush.

U.S. Pat. No. 2,290,359 discloses a brush retainer or folder having front, side and back panels which fold along score lines to contain the bristles and ferrule portion of the brush in a wedge shape which keeps the bristles in an original form before and after use. The brush retainer is closed by insertion of a straight-edged tab into a slot in a back panel of the retainer. U.S. Pat. No. 2,841,273 discloses a paint brush wrapper which is also in a folder form having front, back and side panels which wrap around the bristles and ferrule and lock by insertion of a suitable snap fastener through apertures in overlapping back panel portions.

Such brush keepers have certain functional deficiencies such as failure to remain locked about the brush during handling and retail display or the need for separate components to accomplish closure about the brush which increases production costs. Also, once opened, permanent damage to the keeper locking mechanisms may result, rendering the keepers useless for storing the brush and maintaining the original bristle shape after use.

SUMMARY OF THE INVENTION

The present invention provides one piece foldable reusable brush keepers for straight or angle-tipped brushes which can be repeatedly locked tightly around the bristles and ferrule of the brushes to protect the bristles and maintain them in their original shape before and after use.

In accordance with one aspect of the invention, the brush keeper comprises a single foldable blank of protective material cut and formed to fold and lock around the bristle and bristle-holding portion (the brush portion) of a brush, including a main front panel adapted to cover one face of the brush portion, side panels extending from lateral sides of the main front panel which fold to cover the sides of the brush portion, back inside panels extending outwardly from the side panels which overlappingly cover the opposite face of the brush portion, a bottom panel extending from a bottom edge of the main front panel, a lower back panel extending from the bottom edge of the bottom panel including a locking tab receiving slit, a top panel extending from a top edge of the main front panel including an opening adjacent the main front panel through which the brush handle protrudes, an upper back panel which folds over the opposite face of the brush portion and the overlapping inside panels, and a tapered locking tab extending from a distal end of the upper back panel for locking insertion into the locking tab receiving slit in the lower back panel to secure the back panels together over the overlapping back inside panels to lock the brush keeper about the brush portion.

In accordance with another aspect of the invention, the locking mechanism for the brush keeper includes a narrow neck rounded cornered tapered cam action locking tab which cooperates with a rounded corner inwardly cut receiving slit to allow repeated locking and unlocking of the keeper without damage to the locking mechanism.

In accordance with another aspect of the invention, one back panel of the brush keeper covers more than half of the back of the keeper when folded about the brush portion.

In accordance with another aspect of the invention, the brush keeper includes a first back panel having symmetrically indented side edges adapted for easy gripping to engage and disengage a tab on the first back panel from a slit in a second back panel to selectively close and open the keeper.

In accordance with another aspect of the invention, the brush keeper includes back inside panels which extend across substantially the entire length and width of one face of the brush portion to hold the brush portion more firm and provide maximum surface area for printing on the keeper.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
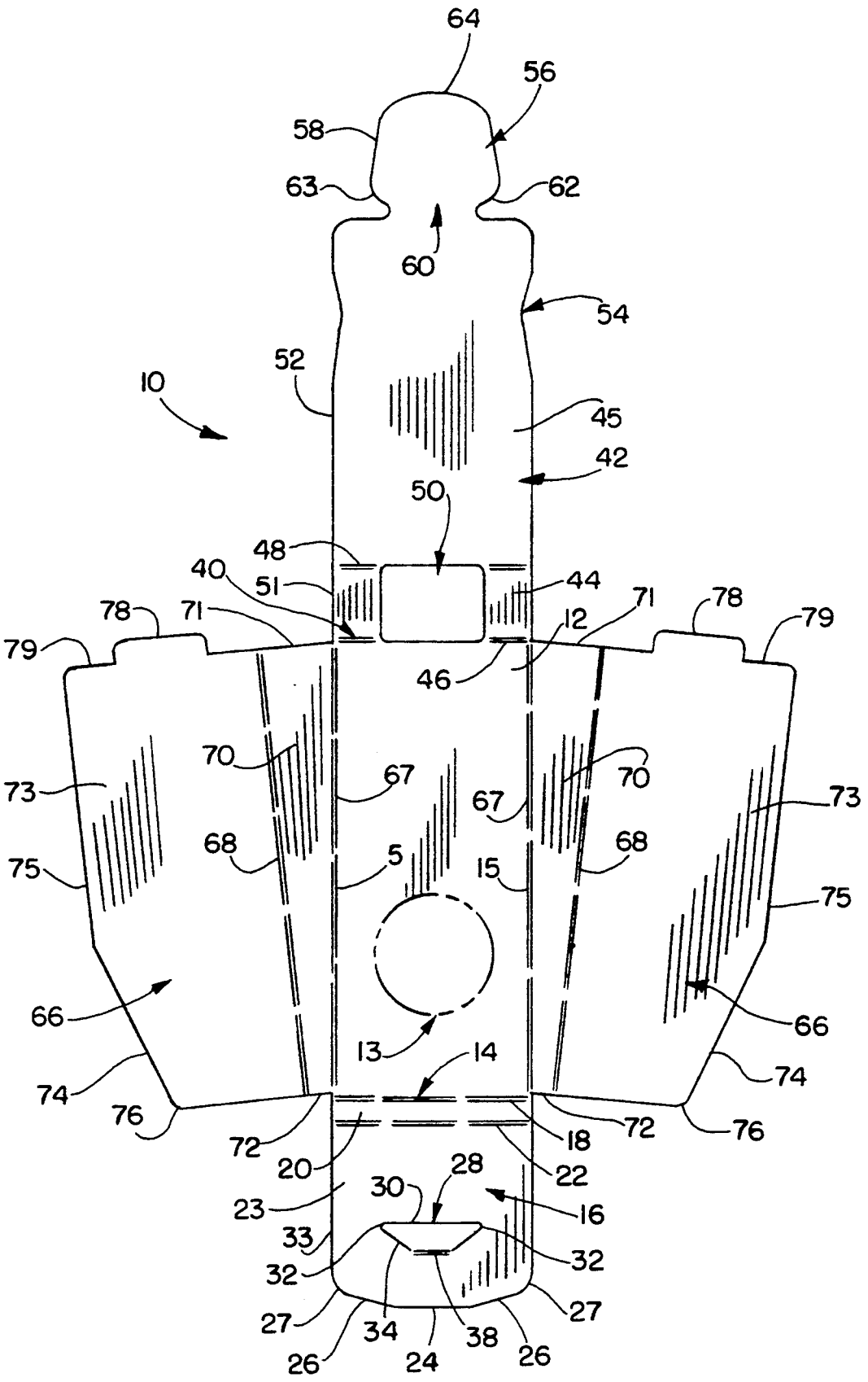
FIG. 1 is a plan view of one form of one-piece foldable reusable brush keeper of the present invention in an unfolded configuration for a straight brush.
Figure 2:
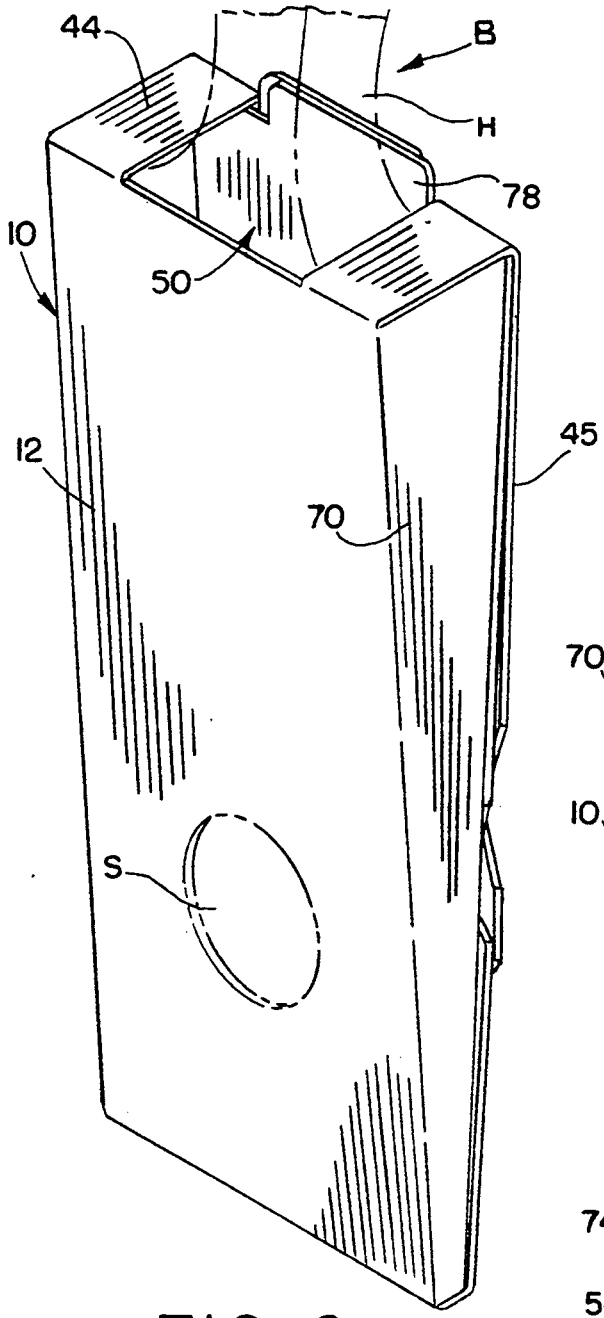
FIGS. 2 and 3 are enlarged perspective views of the brush keeper of FIG. 1 folded and locked about the bristle and bristle-holding portion of a straight brush as seen from the front and back, respectively.

With reference to the drawings, the interior side of a cut out blank or pattern of a brush keeper, indicated generally at 10, is shown in FIG. 1 in an unfolded configuration. The keeper 10 may be constructed of, for example eighteen point solid bleach board, plastic, or other suitable material which may be die cut and folded in the described configurations. A main front panel 12 is dimensioned to cover one entire face of a paint brush B including particularly the bristles S and channel or ferrule F which holds the bristles to the handle H of the brush as shown in FIGS. 2–5. An optional opening 13 may be provided in main front panel 12 in any desired location through which a portion of the bristles S of a brush contained in the keeper are visible.

Figure 5:
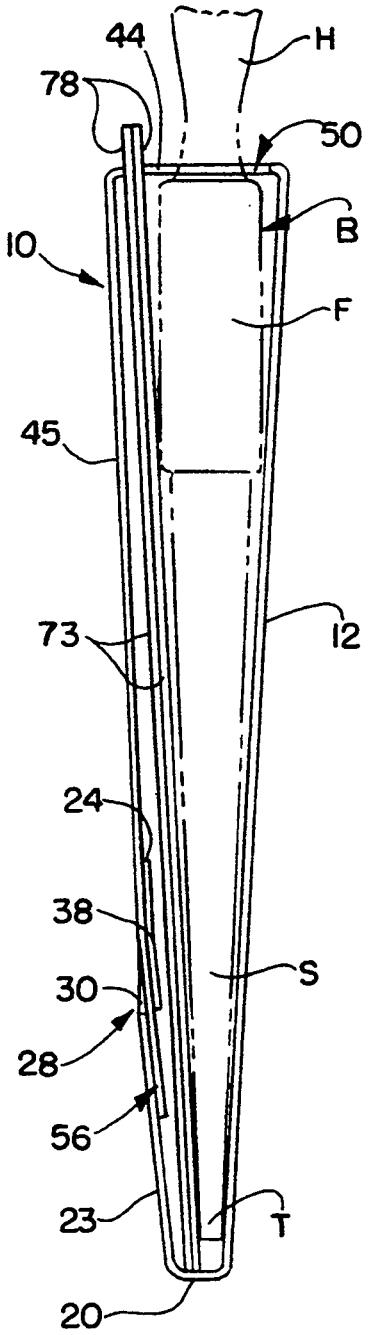
FIG. 5 is a fragmentary longitudinal section through the brush keeper of FIG. 4 shown in a folded and locked position about the bristle and bristle-holding portion.

The bottom edge 14 of main front panel 12 is shown as being substantially straight and perpendicular to the substantially straight and parallel side edges 15 of main front panel 12 for accommodating straight brushes. Extending from bottom edge 14 of main front panel 12 is a lower end panel 16 having a width substantially equal to the main front panel 12 and a length sufficient to wrap around the bristle tip end of the brush and extend over a portion of the length of the opposite or back side of the keeper as described hereafter. A score line 18 is provided along bottom edge 14 of main front panel 12 along which the lower end panel 16 is folded at approximately 90 degrees to define a bottom panel 20 of the keeper. The main front panel 12 is slightly longer than the bristles and bristle holding portion of the brush to be housed, for example approximately ¼ inch longer, so as to avoid direct contact of the bristle tips T with bottom panel 20 as shown in FIG. 5. A second score line 22 on lower end panel 16 spaced and parallel to score line 18 defines the length of bottom panel 20 dimensioned to accommodate the cross sectional width of the bristles at the tip of the brush without compression or crushing, as also shown in FIG. 5.

The remaining portion of lower end panel 16 extending beyond bottom panel 20 defines a lower back panel 23 which when folded at approximately 90 degrees to bottom panel 20 overlies a lower portion of the opposite face of the brush bristles S. The lower back panel 23 terminates at edge 24 which is provided with symmetrical lateral tapers 26 and rounded corners 27 to provide for smooth assembly of the keeper about a brush in a folded and locked configuration as described hereafter.

A locking tab receiving slit, indicated generally at 28, is cut in a central lower position of lower back panel 23. Slit 28 includes a straight edge 30 extending generally perpendicular to the side edges 33 of lower back panel 23, having a width approximately equal to the maximum width of the locking tab described below, symmetrical, rounded corners 32, and symmetrical angled inward edges 34 connected at their ends by a score line 38 parallel to straight edge 30. This construction of slit 28 allows for repeated insertion, locking and unlocking of a locking tab without damage to the keeper as described below.

Figure 3:
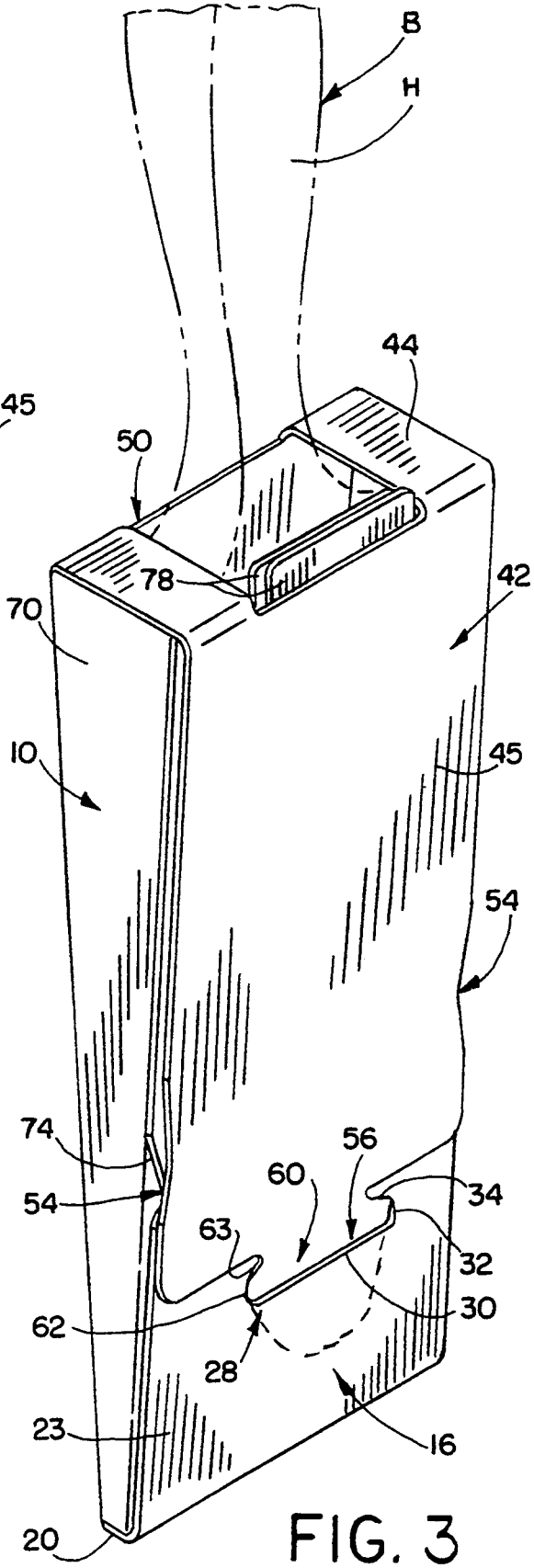

Extending from a top edge 40 of main front panel 12 is an upper end panel 42 including a top panel 44 and upper back panel 45 which in the folded configuration cover the upper end of the bristle holding channel portion or ferrule F and a substantial portion of the other face of the brush bristles and bristle holding channel portion of the brush as illustrated in FIG. 3. Top panel 44 is formed by approximately 90 degree folds along score line 46 at top edge 40, and score line 48 parallel to score line 46 and spaced at a distance sufficient to accommodate the cross-sectional width of the bristle holding channel portion F and the stock of the handle H of the brush. A cutout 50 is provided in top panel 44, between score lines 46 and 48, through which brush handle H protrudes with the keeper 10 locked about the brush. The width of cutout 50 between side edges 51 of top panel 44 is dimensioned to allow the widest portion of the brush handle to pass therethrough.

Side edges 52 of upper back panel 45 are provided with symmetrical gripping indentations 54 adjacent the outer end thereof for easy gripping between the thumb and fingers of a person's hand to engage and disengage locking tab 56 at the outer end of upper back panel 45 with slit 28. FIG. 3 illustrates the locking tab 56 fully engaged in slit 28. Upper back panel 45 has a length dimension sufficient to extend approximately over three fourths of the length of the main panel 12 when in the folded condition. In addition to increasing the structural rigidity of the keeper in the folded configuration, the length of the upper back panel 45 provides ample surface area upon which information, for example, pertaining to the brush and the manufacturer, can be printed.

Figure 4:
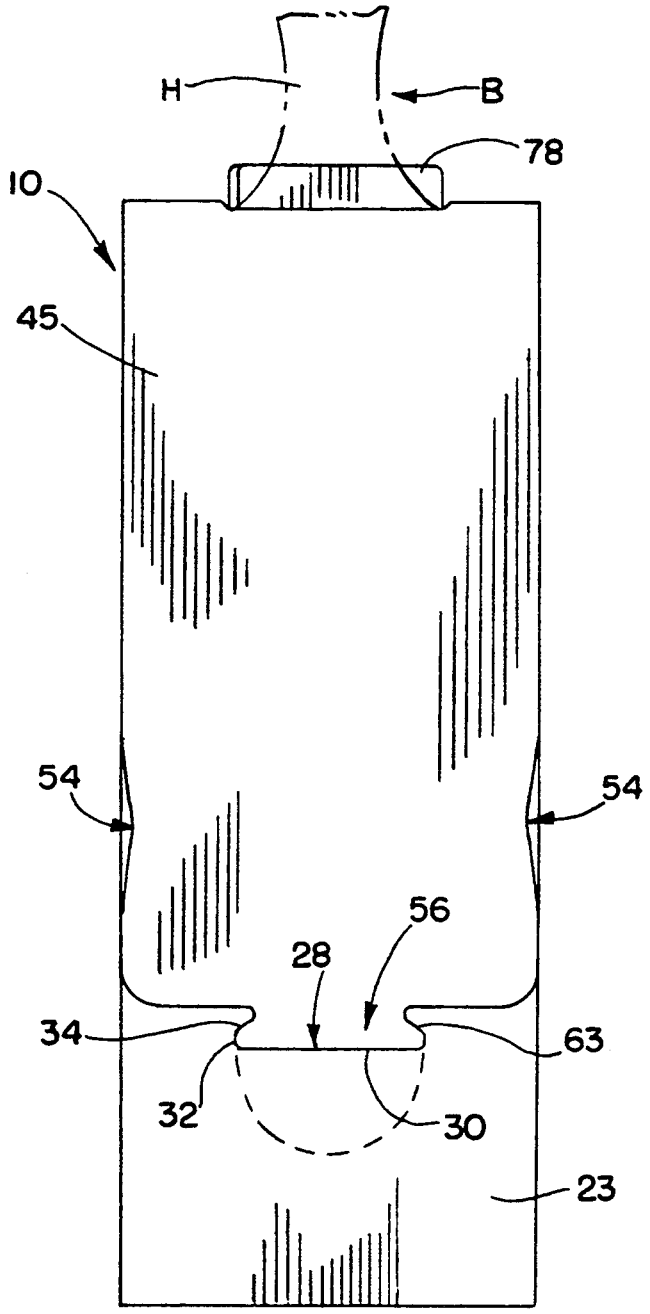
FIG. 4 is an elevation view of the back of the brush keeper of FIG. 3 shown in a folded and locked position.

Locking tab 56 has symmetrical sides 58 that are tapered in the manner shown in FIG. 1 to ease insertion of locking tab 56 into slit 28, improve the locking function of the tab once inserted, and to avoid damage to the tab or slit upon repeated locking and unlocking of the keeper. Tab 56 has a relatively narrow neck 60 at the distal end of upper back panel 45, formed by curves 62 providing shoulders 63 which lead into the widest portion of tab 56 which is approximately equal to the maximum width of straight edge 30 in slit 28. Tapered symmetrical sides 58 taper symmetrically inward from curves 62 toward rounded tip 64 which has a width less than that of straight edge 30 in slit 28 to minimize frictional resistance to and guide the initial insertion of tab 56 into slit 28. As shown in FIGS. 3–5, upon full insertion of tab 56 into slit 28, the maximum width portion of tab 56 passes the rounded corners 32 of slit 28 whereupon shoulders 63 adjacent neck 60 of tab 56 frictionally engage inwardly angled edges 34 of slit 28 to perform a locking function which holds upper back panel 45 firmly in place and resists disengagement of the tab from the slit 28 during normal handling. The cam-like locking action of curves 62 of tab 56 against rounded corners 32 of slit 28 avoids damage to the edges of the tab 56 and slit 28 to enable the keeper to be repeatedly locked and unlocked while maintaining substantially the same frictional force of the tab lock. Also, the tapered edges 26 at the outer end of the lower back panel 23 allow for smooth insertion of the tab 56 into the slit 28. By this construction, the keeper 10 can withstand repeated openings and closings during retail inspection and use as a bristle preserving storage container following use of the brush.

To cover and retain the sides of the brush bristles and brush ferrule (the brush portion) within the keeper 10 and provide structural rigidity to the back of the keeper, lateral panels 66 are provided which extend laterally from side edges 15 of main front panel 12 along the entire length of main front panel 12 (see FIG. 1). Lateral panels 66 are folded at approximately ninety degrees along score lines 67 (along side edges 15 of main front panel 12), and score lines 68 which run the entire length of lateral panels 66 and are slightly angled relative to score lines 67 to provide side panels 70 which taper toward the bottom of the keeper in accordance with the cross-sectional profile taper of the brush portion to cover and retain the sides of the brush portion in the keeper as shown in FIG. 5. The top and bottom edges 71 and 72 of side panels 70 are substantially parallel to each other, with the top edges 71 having a length substantially the same as top panel 44 between score lines 46, 48, and the bottom edges 72 having a length substantially the same as bottom panel 20 between score lines 18 and 22, thus defining substantially trapezoidal-shaped side panels 70 having a shape substantially corresponding to the cross sectional shape of the brush portion.

Figure 6:
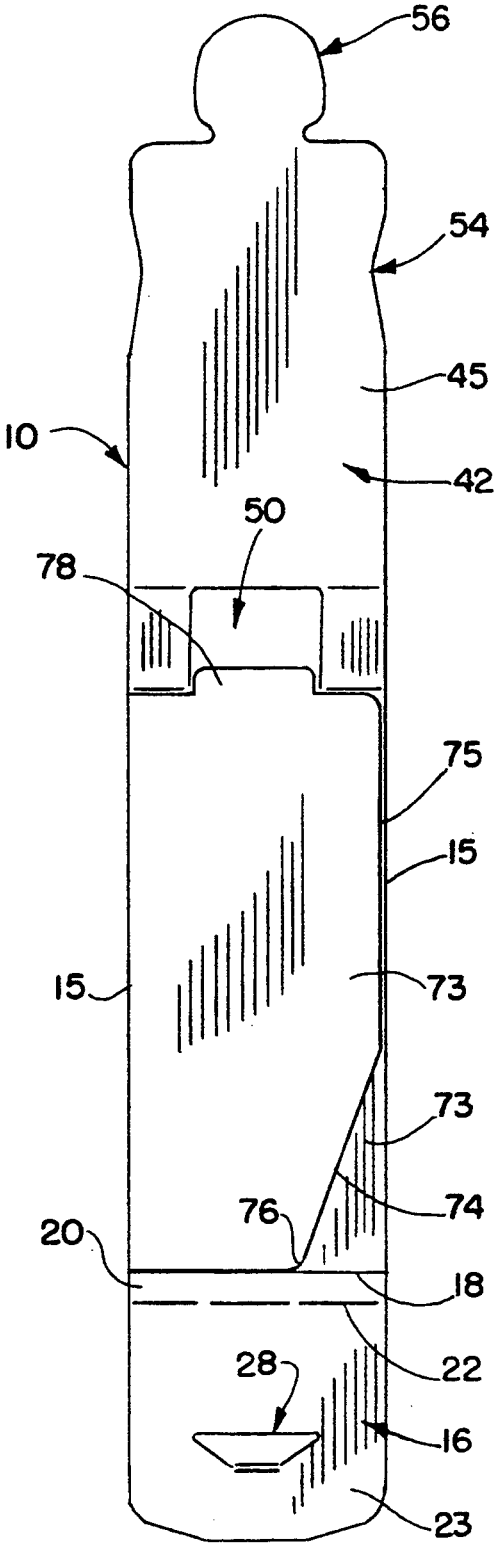
FIG. 6 is a plan view of the brush keeper of FIG. 1 in a partially folded configuration.

The remaining portion of lateral panels 66 define back inside panels 73 which are folded over the back of the brush portion, opposite main front panel 12, one overlapping the other, with the outer lateral edges 75 of both panels 73 being substantially in line with the opposite side edges 15 of main panel 12 as shown in FIG. 6 to increase the structural rigidity of the keeper in the folded condition and hold the brush portion more firm. The expanse of each back inside panel 73 over the length and width of the keeper when folded also provides ample area on the exterior face of each back inside panel for printing of additional information.

With the lateral panels 66 in this folded position, lower end panel 16 is folded around the bristle tip of the brush over the back inside panels 73, and upper end panel 42 with the brush handle H inserted through cutout 50 is folded over the top of the bristle-holding portion of the brush and over the back inside panels 73 and lower back panel 23 so that locking tab 56 may be engaged in the locking tab receiving slit 28 as described hereafter to retain the keeper in the closed configuration of FIGS. 2–5.

The lower portions 74 of outer lateral edges 75 of back inside panels 73 are tapered to position bottom corners 76 slightly inboard of side edges 15 when the keeper is folded as shown in FIG. 6 to avoid catching bristle tips between the panel edges 75 and side panels 70, and to avoid binding of the edges 75 of the underlapped panels 73 against the interior of the opposite side panels 70 upon folding the keeper. Tabs 78, having a width approximately equal to that of cutout 50, extend upward from the top edges 79 of panels 73 to protrude through cutout 50 flush with the upper back panel 45 of the keeper to keep side panels 70 in and square, and to provide additional structural rigidity by preventing lateral shifting of the keeper about the brush portion.

Figure 7:
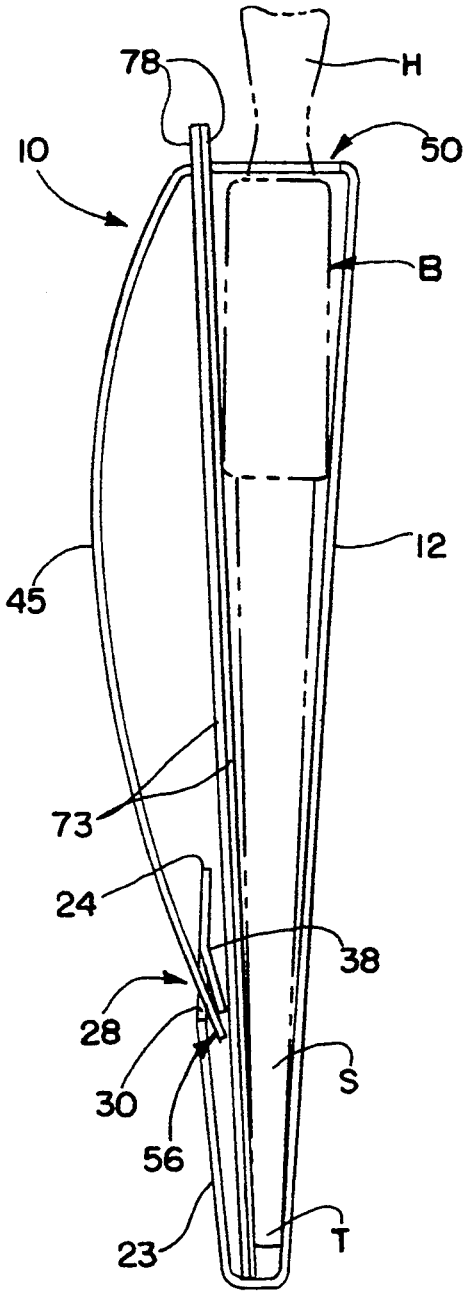
FIG. 7 is a fragmentary longitudinal section through the brush keeper showing how the locking tab is inserted at an angle into the tab receiving slit during closing of the keeper.

One of the unique features of the brush keeper 10 of the present invention is the way it closes and locks. When closing, the locking tab 56 is inserted at an angle relative to the slit 28 in the folded up lower back panel 23 as schematically shown in FIG. 7. This allows the locking tab 56 to slide into the slit 28 without interfering with the locking mechanism. When the locking tab 56 is inserted all the way into the slit 28, the angle between the upper and lower back panels 45 and 23 reduces to near zero, whereby the upper back panel 45 lies substantially parallel and flat against the lower back panel 23 underneath as shown in FIG. 5.

With the locking tab 56 fully inserted into the slit 28, tension put on the brush keeper by grasping the two back panels 45 and 23 and pulling in a linear direction or by grasping the keeper and pulling on the brush handle in an opposite linear direction causes the shoulders 63 of tab 56 to engage the inwardly angled edges 34 of slit 28 (see FIGS. 3 and 4) and resist opening of the keeper.

To open the keeper, the lower back panel 23 is grasped or retained and the upper back panel 45 is pulled up in the middle as in FIG. 7, which allows the locking tab easily to be removed from the slit 28. The indentations 54 on the upper back panel 45 help to insert the locking tab at an angle into the slit 28 to close the keeper, and grasp and lift the locking tab to remove it from the slit 28 at an angle.

Figure 8:
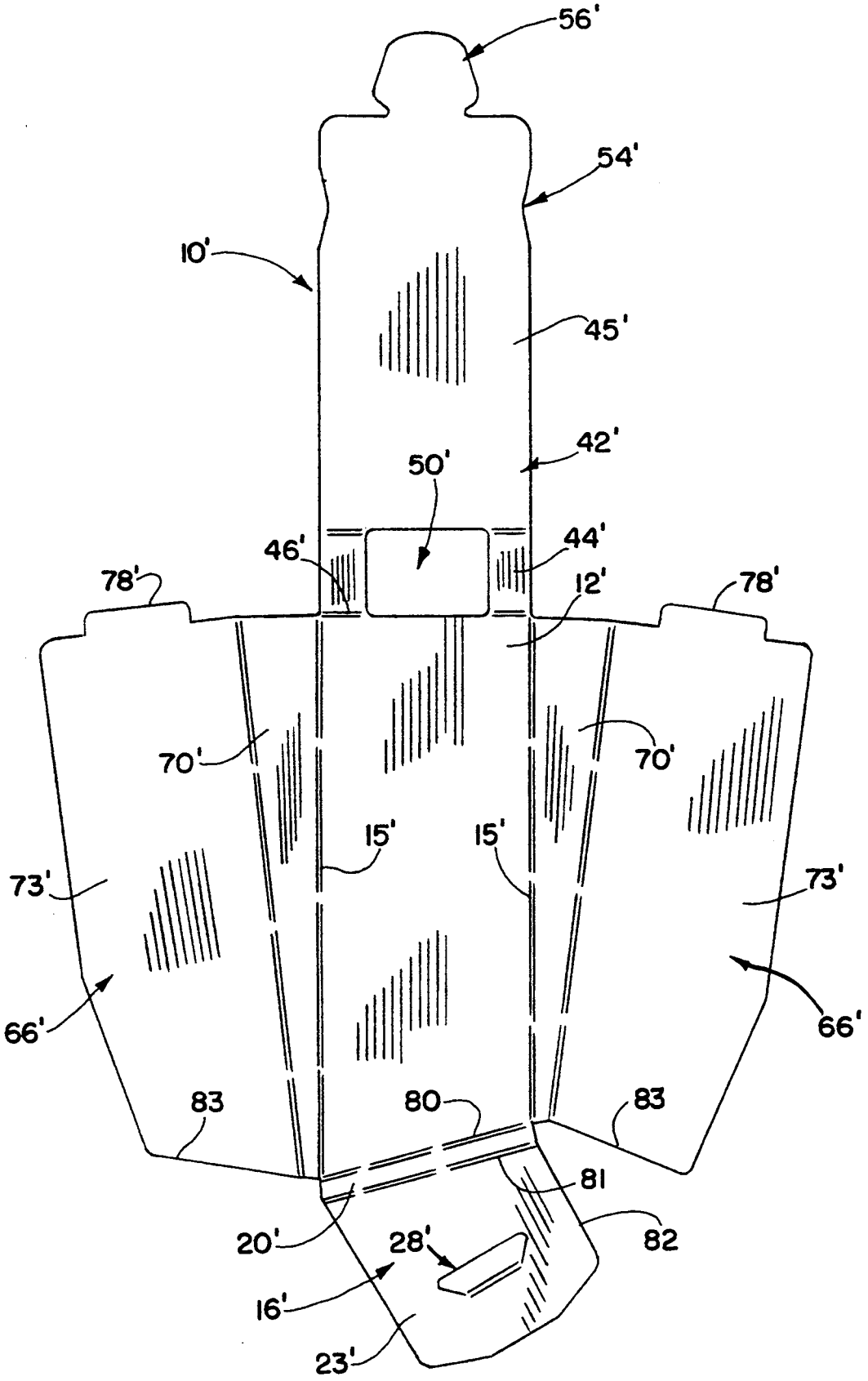
FIG. 8 is a plan view of another form of brush keeper of the present invention in an unfolded configuration for an angled brush.

FIG. 8 illustrates a modified form of keeper 10′ in accordance with the present invention designed to accommodate angle-tipped brushes. Bottom panel 20′ may be formed to be slanted at any desired angle to accommodate brushes of any tip angle by folding along angled score lines 80 and 81, angled relative to top edge 46′ of main front panel 12′. In this embodiment, in order that lower back panel 23′ folds square with respect to main front panel 12′, side edges 82 of lower back panel 23′ are angled relative to side edges 15′ of main front panel 12′ for alignment upon folding of edges 82 with edges 15′.

To provide maximum coverage of back inside panels 73′ of the back of the brush portion in the angle tipped embodiment of the keeper 10′ shown in FIG. 8, bottom edges 83 of back inside panels 73′ are also angled to match angled score line 80 when in the folded configuration so that the back of the brush bristles are covered all the way to the tips. All other aspects of the angled tipped brush keeper 10′ shown in FIG. 8 are substantially the same as the straight tipped brush keeper 10 previously described. Accordingly the same reference numerals followed by a prime symbol (′) are used to designate the same/similar parts.

Lastly it is noted that all of the exterior corners of the keepers 10 and 10′ are rounded for ergonomic efficiency and a finished look to the keeper when assembled.

Although the invention has been shown and described with respect to certain preferred embodiments, equivalent alterations and modifications will occur to those skilled in the art upon reading and understanding the specification. The present invention includes all such equivalent alterations and modifications, and is limited only by the scope of the following claims.

What is claimed is:

1. A brush keeper for housing the bristles and bristle holding portion of a brush comprising, a main front panel dimensioned to cover a front face of the bristles and bristle holding portion of the brush, lateral panels extending from opposite lateral side edges of said main front panel to be folded around opposite lateral sides of the brush and overlappingly cover a back face of the bristles and bristle holding portion, an upper end panel extending from a top edge of said main front panel to be folded over a top of the bristle holding portion and extend over said lateral panels and the back face of the bristles and bristle holding portion, said upper end panel having a tapered locking tab extending from a distal end opposite said top edge of said main front panel, and a lower end panel extending from a bottom edge of said main front panel to be folded around tips of the bristles and extend over the back face, said lower end panel having an aperture for receiving said locking tab whereby the keeper is secured about the brush by insertion of said locking tab into said aperture.

2. The brush keeper of claim 1 wherein said main front panel has a length dimension greater than a length dimension of the bristles and bristle holding portion combined so that the tips of the bristles do not touch said lower end panel.

3. The brush keeper of claim 1 wherein said main front panel further includes an opening through which the bristles of the brush within said keeper are visible.

4. The brush keeper of claim 1 wherein said lateral panels have a length dimension approximately equal to a length dimension of said main front panel.

5. The brush keeper of claim 1 wherein a lower outer edge portion of each of said lateral panels is tapered to a width less than a width of said main front panel.

6. The brush keeper of claim 1 wherein said upper end panel includes a top panel containing an opening through which a handle of the brush within said keeper extends.

7. The brush keeper of claim 6 wherein a top edge of each of said lateral panels includes an upwardly projecting tab adapted to fit through said opening in said upper back panel.

8. The brush keeper of claim 6 wherein said upper end panel also includes an upper back panel extending from a top edge of said top panel.

9. The brush keeper of claim 8 wherein said upper back panel has a length dimension equal to at least three fourths of a length dimension of said main front panel.

10. The brush keeper of claim 8 wherein opposite side edges of said upper back panel are indented for easy gripping between a person's thumb and fingers to engage and disengage said locking tab with said aperture.

11. The brush keeper of claim 8 wherein said locking tab includes a neck having a width less than a width of said upper back panel, symmetrical radially rounded edges outwardly flaring from said neck to form shoulders spaced apart and facing a distal end of said upper back panel, a maximum width at said shoulders greater than the width of said neck, and tapering edges from said shoulders to an insertion end of said locking tab.

12. The brush keeper of claim 11 wherein said maximum width of said locking tab is approximately equal to a width of said aperture in said lower end panel.

13. The brush keeper of claim 12 wherein said aperture in said lower end panel comprises a locking tab receiving slit parallel to said bottom edge of said main front panel, said slit having a width approximately equal to said maximum width of said locking tab, and radially rounded corners at each end of said slit and continuing in inwardly angled symmetrical edges.

14. The brush keeper of claim 13 wherein, when said locking tab is fully inserted into said locking tab receiving slit, said shoulders of said locking tab are in contact with said radially rounded corners and said inwardly angled symmetrical edges of said slit to hold said upper back panel in a closed position over said lateral panels and the back face of the brush within the keeper.

15. The brush keeper of claim 1 wherein said lower end panel has outer tapered edges to allow for smooth insertion of said tapered locking tab into said aperture.

16. The brush keeper of claim 1 wherein a cross sectional width of said keeper is tapered from top to bottom when said upper end panel is folded over the top of the bristle holding portion of the brush and said lower end panel is folded around the tips of the bristles.

17. The brush keeper of claim 16 wherein said lateral panels include trapezoidal shaped side panels having a shape substantially corresponding to a cross sectional shape of the bristles and bristle holding portion of the brush.

18. The brush keeper of claim 17 wherein said upper end panel includes a top panel to be folded over the top of the bristle holding portion and an upper back panel to extend over a substantial portion of the length of the back face of the bristles and bristle holding portion, and said lower end panel includes a bottom panel to be folded around the tips of the bristles and a lower back panel to extend over a portion of the length of the bristles, said top panel having a length somewhat greater than the length of said bottom panel, and said side panels having parallel top and bottom edges of a length approximately equal to the length of said top and bottom panels, respectively.

19. The brush keeper of claim 1 wherein said bottom edge of said main front panel is perpendicular to said lateral side edges of said main front panel.

20. The brush keeper of claim 1 wherein said bottom edge of said main front panel is angled to be non-perpendicular to said lateral side edges of said main front panel so that said lower end panel when folded around the bristle tips is angled relative to said top edge of said main front panel.

21. A one piece foldable keeper for a brush comprising a front panel adapted to cover a front face of bristles and a bristle holding portion of a brush, lateral side panels and back inside panels each dimensioned to be folded respectively to cover sides and a back face of said bristles and bristle holding portion, each of said back inside panels having outer lateral edges extending to an opposite lateral side of said front panel, a lower end panel extending from a bottom edge of said front panel dimensioned to be folded to cover tips of said bristles and extend over said back inside panels, an upper end panel extending from a top edge of said front panel dimensioned to be folded over a top of the bristle holding portion and said back inside panels, and having an aperture for a handle of the brush to extend therethrough, and means for releasably securing said upper back panel to said lower back panel.

22. The keeper of claim 21 wherein lower portions of said outer lateral edges are tapered to avoid catching bristle tips between said outer lateral edges and said side panels.

23. The keeper of claim 21 wherein said means for releasably securing comprises a tapered locking tab extending from a distal end of said upper end panel and an aperture in said lower end panel for receiving said locking tab.

24. The keeper of claim 23 wherein said locking tab includes a neck having a width less than a width of said upper end panel, symmetrical radially rounded edges outwardly flaring from said neck to form shoulders spaced apart and facing a distal end of said upper end panel, a maximum width at said shoulders greater than the width of said neck, and tapering edges from said shoulders to an insertion end of said locking tab, and said aperture in said lower end panel comprises a locking tab receiving slit parallel to said bottom edge of said front panel, said slit having a width approximately equal to said maximum width of said locking tab, and radially rounded corners at each end of said slit and continuing in inwardly angled symmetrical edges which intersect with spaced apart vertical edges, said vertical edges being spaced at a width less than the width of said locking tab receiving slit.

* * * * *